United States Patent [19]

Matsui et al.

[11] Patent Number: 4,643,597

[45] Date of Patent: Feb. 17, 1987

[54] DOT PRINTER

[75] Inventors: Tsutomu Matsui; Shinichiro Fujii; Mitsutoshi Kakishima, all of Shizuoka, Japan

[73] Assignee: Tokyo Electric Co., Ltd., Tokyo, Japan

[21] Appl. No.: 686,899

[22] Filed: Dec. 27, 1984

[30] Foreign Application Priority Data

Dec. 28, 1983 [JP] Japan ..... 58-200459
Dec. 28, 1983 [JP] Japan ..... 58-200460

[51] Int. Cl.[4] ..... B41J 3/04; B41J 25/28; B41J 11/22

[52] U.S. Cl. ..... 400/124; 400/320; 400/352; 400/175

[58] Field of Search ..... 400/124, 175, 320, 352, 400/354, 355, 356, 357; 101/93.04, 93.05

[56] References Cited

U.S. PATENT DOCUMENTS

| | | | |
|---|---|---|---|
| 3,666,071 | 5/1972 | Purr | 400/355 X |
| 4,381,896 | 5/1983 | Shiurila | 400/320 X |
| 4,420,269 | 12/1983 | Ackermann et al. | 400/356 |

FOREIGN PATENT DOCUMENTS

| | | | |
|---|---|---|---|
| 1139853 | 11/1962 | Fed. Rep. of Germany | 400/357 |
| 2544429 | 2/1977 | Fed. Rep. of Germany | 400/357 |
| 123488 | 9/1980 | Japan | 400/320 |
| 60285 | 5/1981 | Japan | 400/320 |
| 66990 | 4/1982 | Japan | 400/320 |

*Primary Examiner*—Edgar S. Burr
*Assistant Examiner*—James R. McDaniel
*Attorney, Agent, or Firm*—Oblon, Fisher, Spivak, McClelland, & Maier

[57] ABSTRACT

A dot printer wherein a bearing member is movably attached to each of two shafts disposed in parallel with a platen, and a plurality of electromagnets are secured to the bearing members together with a head which houses therein a plurality of needles driven by the electromagnets. In this arrangement, the necessity of employing a carrier can be eliminated to simplify the structure as well as to reduce both the dimensions and the weight of the whole while ensuring a high-speed printing operation with another advantage of facilitating the assembling process.

19 Claims, 6 Drawing Figures

DOT PRINTER

FIELD OF THE INVENTION

The present invention relates to a dot printer and, more particularly, to a type which forms dots on a recording sheet by selectively driving needles arrayed in a head and thereby prints a character, figure, pattern or the like with an aggregation of such dots.

OBJECTS OF THE INVENTION

It is a first object of the present invention to reduce the weight of movable mechanisms including a printer head.

A second object of the invention is to eliminate the necessity of employing a carrier.

A third object of the invention resides in providing some allowance in the precision of attachment of a shaft which is to be disposed in parallel with a platen.

A fourth object of the invention is to realize a high-speed printing operation.

A fifth object of the invention resides in facilitating the assembling process.

Other objects and advantages of the invention will become apparent from the following description.

PRIOR ART

Figure 1:
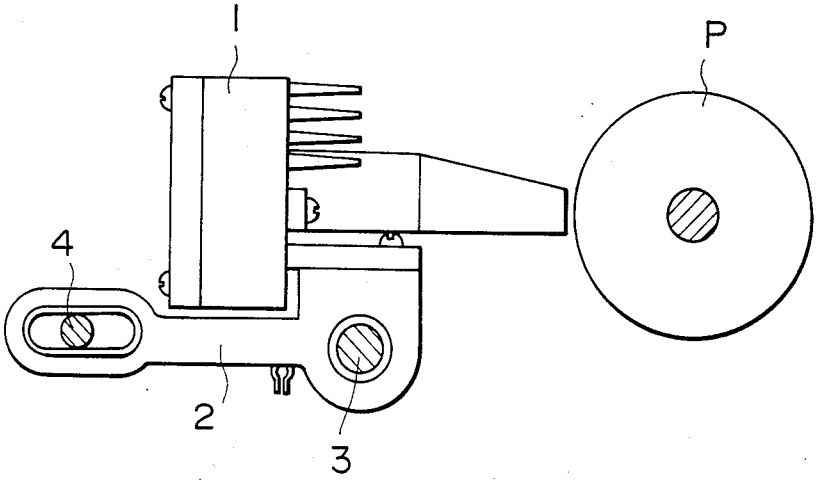
FIG. 1 PRIOR ART
FIG. 1 is a side view of a conventional dot printer known heretofore.

A conventional dot printer of the type mentioned will now be described with reference to FIG. 1, wherein a dot printer head 1 disposed opposite to a platen P is held by a carrier 2 which is supported at both ends thereof by two shafts 3 and 4 parallel with the platen P. The carrier 2 is so shaped as to conform to the dot printer head 1 with a complicated contour and needs to have a considerable mechanical strength. It is therefore unavoidable that the carrier 2 becomes large dimensionally and great in weight, so that the shafts 3 and 4 are also required to be thick correspondingly thereto, hence necessitating a sufficient strength with regard to the bearing mechanism as well. In addition, the inertia is also rendered greater with increase of the weight to eventually bring about difficulties in achieving fast start and stop, whereby high-speed printing is hardly realizable.

Furthermore, in the conventional structure where a carrier is supported by two shafts, it is necessary to assemble the two shafts simultaneously with the carrier attached thereto, so that the assembling work naturally encounters technical difficulties.

PREFERRED EMBODIMENTS OF THE INVENTION

Figure 2:
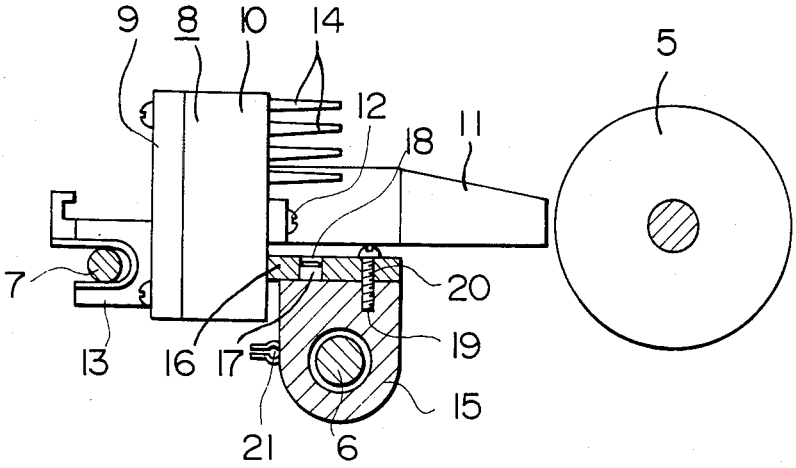
FIG. 2 is a partially cutaway side view of a first exemplary dot printer embodying the present invention.

Hereinafter a first exemplary embodiment of the present invention will be described with reference to FIGS. 2 through 4, in which a platen 5 and two shafts 6 and 7 are disposed in parallel with a pair of frames (not shown) extending leftward and rightward. A printer head 8 is opposed through an ink ribbon **5*b* to a recording sheet 5*a* held around the platen 5. The printer head 8 comprises a housing 10 with an openable cover 9 and a guide frame 11 connected to the housing 10 by means of a screw 12. In a modification, the housing 10 and the guide frame 11 may be formed integrally with each other. A plurality of electromagnets (not shown) are incorporated in the housing 10, and needles (not shown) to be driven by the electromagnets are held slidably on the guide frame 11**.

The cover 9 has U-shaped bearing portions 13 formed integrally therewith and open in one direction to be slidably fitted to the shaft 7. The housing 10 has a plurality of radiation fins 14 and a mount element 16 formed integrally with the housing 10 for attachment thereof to two bearing members 15. There are formed in the mount element 16 two positioning holes 18 into each of which a pin 17 projecting from the corresponding bearing member 15 is fitted, and also another hole 20 to permit insertion of a screw 19 as a set member for attachment to the corresponding bearing member 15. And a lock portion 21 is provided on each of the bearing members 15 integrally therewith so as to lock a wire (not shown) driven by a motor (not shown).

Figure 3:
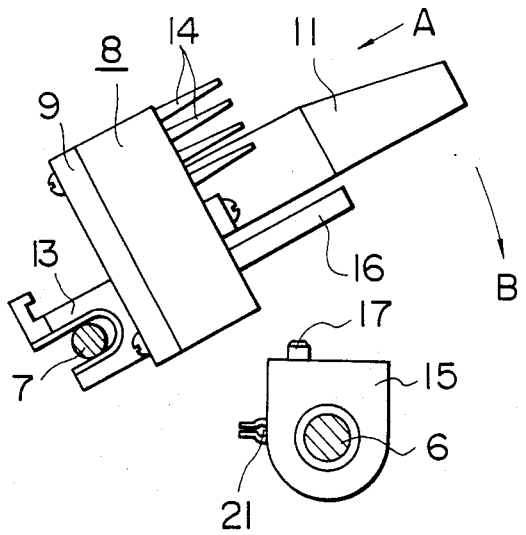
FIG. 3 is a side view illustrating means for attachment of a printer head to a bearing member in the embodiment of FIG. 2.
Figure 4:
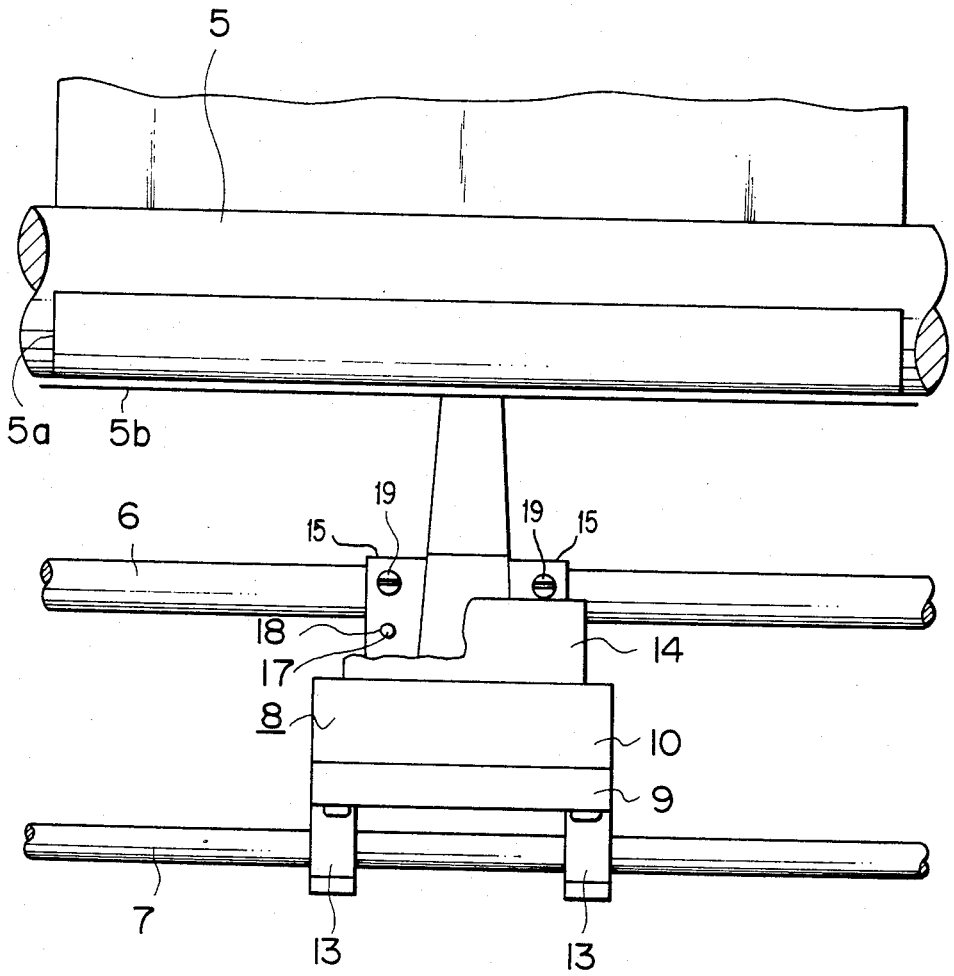
FIG. 4 is a top view of the embodiment shown in FIG. 2.

In the arrangement mentioned above, the head printer 8 is inclined as illustrated in FIG. 3 and then is moved in the direction of an arrow A to fit the bearing portions 13 to the shaft 7. Subsequently the printer head 8 is rotated on the shaft 7 as indicated by an arrow B to bring the pins 17 into engagement with the holes 18 so as to be positioned, and finally the screws 19 inserted into the hole 20 are engaged through threads with the bearing members 15 to hold the printer head 8.

In a printing operation, the bearing members 15 are displaced by pulling the wire connected to the motor. Since the printer head 8 is held directly by the bearing portions 13 on one shaft 7, each bearing member 15 supporting a partial region of the printer head 8 may be extremely small to meet the requirement and has a high rigidity. Meanwhile, the printer head 8 is equipped with a sufficient rigidity for securing the internal electromagnets and a yoke thereof while protecting them and is further reinforced by the aid of radiation fins 14. Each of the bearing portions 13 also retains an adequately high rigidity, since it is formed integrally in the shape of a small block at the center of the cover 9. Consequently a sufficient mechanical strength is obtainable for moving the printer head 8. Thus, it becomes possible to eliminate the carrier to offer advantages of simplifying the structure as well as reducing both the dimensions and the weight. As a result, the inertia of both the printer head 8 and the bearing member 15 is rendered smaller to be suitable for rapid printing, and the elimination of a large-sized carrier is effective in reducing the production cost.

Furthermore, the shafts 6 and 7 can be installed individually to facilitate the assembling process with remarkable enhancement. Since the shaft 6 is assembled by attaching the bearing members 15 thereto, each shaft can be installed individually to ensure a high operational efficiency.

Figure 5:
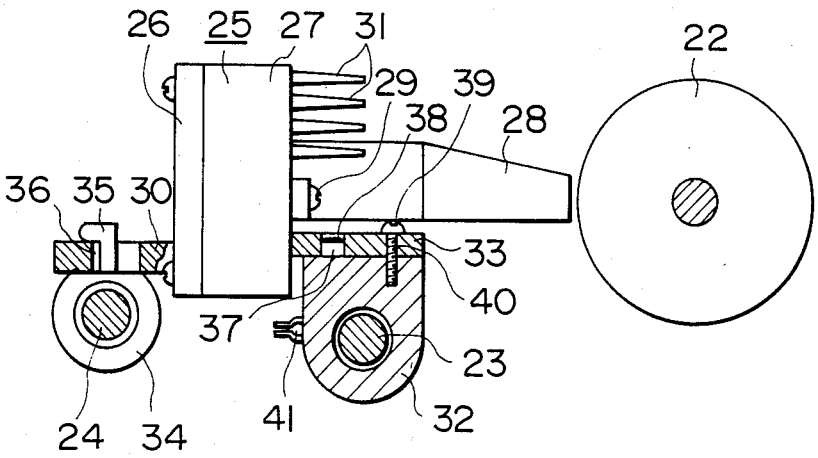
FIG. 5 is a partially cutaway side view of a second exemplary dot printer embodying the invention.

Now a second exemplary embodiment of the invention will be described below with reference to FIGS. 5 and 6, in which a platen 22 and two shafts 23 and 24 are disposed in parallel with a pair of unshown frames extending leftward and rightward. A printer head 25 comprises a housing 27 with an openable cover 26 and a guide frame 28 connected to the housing 27 by means of a screw 29. In a modification, the housing 27 and the guide frame 28 may be formed integrally with each other. A plurality of electromagnets (not shown) are incorporated in the housing 27, and needles (not shown) to be driven by the electromagnets are held slidably on the guide frame 28. The cover 26 has a mount element 30 formed integrally therewith for attachment to bearing members 34, and on the housing 27 are formed radiation fins 31 and a mount element 33 for attachment to bearing members 32. An L-shaped hook 35 serving as a holding member is provided on each of the bearing members 34 retained slidably on one shaft 24, and an opening 36 engageable with each of the hooks 35 is formed in the mount element 30. Meanwhile in the other mount element 33, there are formed two positioning holes 38 each of which is fittable to a corresponding pin 37 projecting from the bearing member 32 and also another hole 40 for attachment to the bearing member 32 by means of a screw 39. Furthermore, a lock portion 41 is provided on each of the bearing members 32 integrally therewith so as to lock a wire (not shown) driven by a motor (not shown).

Figure 6:
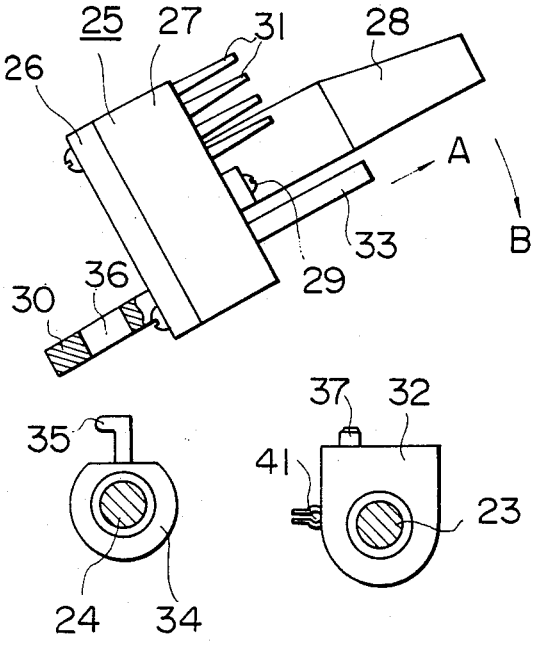
FIG. 6 is a side view illustrating means for attachment of a printer head to a bearing member in the embodiment of FIG. 5.

In the arrangement mentioned above, first the printer head 25 is inclined as illustrated in FIG. 6 and then the hooks 35 are fitted into the openings 36. Subsequently the printer head 25 is displaced in the direction of an arrow A and is rotated as indicated by an arrow B while being maintained in engagement with the hooks 35 until the pins 37 are fitted into the holes 38, and the screws 39 inserted into the holes 40 are engaged through threads with the bearing members 32.

In a printing operation, the bearing members 32 are displaced by pulling the wire connected to the motor. Since the printer head 25 is held by the bearing members 32 and 34 at two positions respectively, each of the bearing members 32 and 34 may be extremely small to meet the requirement and has a high rigidity. Meanwhile, the printer head 25 is equipped with a sufficient rigidity for securing the internal electromagnets and a yoke thereof while protecting them and is further reinforced by the aid of the radiation fins 31. Consequently an adequate mechanical strength is obtainable for moving the printer head 25. Thus, it becomes possible to eliminate the carrier to offer advantages of simplifying the structure as well as reducing both the dimensions and the weight. As a result, the inertia of both the printer head 25 and the bearing members 32 and 34 is rendered smaller to be suitable for rapid printing, and elimination of the carrier is effective in reducing the production cost.

What is claimed is:

1. A dot printer comprising:

(a) a platen for holding a recording sheet;

(b) a first shaft disposed in parallel with said platen;

(c) a second shaft disposed in parallel with said platen and with said first shaft;

(d) a printer head;

(e) at least one U-shaped bearing located on said printer head, said at least one U-shaped bearing being sized, shaped, and positioned so that said printer head can be assembled onto said first shaft by sliding the open end of said at least one U-shaped bearing over said first shaft and so that, in use, said at least one U-shaped bearing journals said first shaft;

(f) a mount element located on said printer head and extending toward said second shaft;

(g) at least one annular bearing member slidably mounted on said second shaft; and (h) first means for releasably connecting said mount element to said at least one annular bearing member, said first means comprising:

(i) at least one pin protruding from one of said mount element and said at least one annular bearing member, (ii) a positioning hole located in the other one of said mount element and said at least one annular bearing member and being sized, shaped, and positioned to receive said at least one pin; and (iii) means to positively hold said pin in said hole, said last mentioned means being releasable to permit removal and replacement of said printer head.

2. A dot printer as recited in claim 1 and further comprising a lock portion mounted on said at least one annular bearing member for gripping a wire for moving said printer head relative to said platen.

3. A dot printer as recited in claim 1 wherein said means to positively hold comprise:

(a) at least one threaded fastener which comprises a head portion and a body portion;

(b) at least one threaded hole located in one of said mount element and said at least one annular bearing member and being sized and shaped to threadedly receive the body portion of said at least one threaded fastener; and (c) at least one throughhole located in the other one of said mount element and said at least one annular bearing member and being sized, shaped, and positioned to align with said at least one threaded hole, to pass the body portion of said at least one threaded fastener, and to engage the head portion of said at least one threaded fastener.

4. A dot printer as recited in claim 1 wherein said at least one U-shaped bearing is mounted on said printer head.

5. A dot printer as recited in claim 1 wherein said mount element is mounted on said printer head.

6. A dot printer as recited in claim 1 wherein:

(a) a pair of U-shaped bearings are located on said printer head;

(b) a pair of annular bearing members are slidably mounted on said second shaft; and (c) said first means comprise:

(i) two pins, each one of said two pins protruding from one of said mount element and each one of said pair of annular bearing members, and (ii) two positioning holes, each one of said two positioning holes being located in the other one of said mount element and each one of said pair of annular bearing members and being sized, shaped, and positioned to receive a corresponding one of said two pins.

7. A dot printer comprising:

(a) a platen for holding a recording sheet;

(b) a first shaft disposed in parallel with said platen;

(c) a second shaft disposed in parallel with said platen and with said first shaft;
(d) a printer head;
(e) a first mount element located on said printer head and extending toward said first shaft;
(f) a second mount element located on said printer head and extending toward said second shaft;
(g) at least one first annular bearing member slidably mounted on said first shaft;
(h) at least one second annular bearing member slidably mounted on said second shaft;
(i) first means for releasably connecting said first mount element to said at least one first annular bearing member, said first means comprising:
(i) at least one pin protruding from one of said first mount element and said at least one first annular bearing member;
(ii) at least one positioning hole located in the other one of said first mount element and said at least one first annular bearing member and being sized, shaped, and positioned to receive said at least one pin; and
(iii) means to positively hold said pin in said hole, said last mentioned means being releasable to permit removal and replacement of said printer head;
(j) second means for releasably connecting said second mount element to said at least one second annular bearing member.

8. A dot printer as recited in claim 7 and further comprising a lock portion mounted on said at least one first annular bearing member for gripping a wire for moving said printer head relative to said platen.

9. A dot printer as recited in claim 7 wherein said means to positively hold:
(a) at least one threaded fastener which comprises a head portion and a body portion;
(b) at least one threaded hole located in one of said first mount element and said at least one first annular bearing member and being sized and shaped to threadedly receive the body portion of said at least one threaded fastener; and
(c) at least one throughhole located in the other one of said first mount element and said at least one first annular bearing member and being sized, shaped, and positioned to align with said at least one threaded hole, to pass the body portion of said at least one threaded fastener, and to engage the head portion of said at least one threaded fastener.

10. A dot printer as recited in claim 7 wherein said second means comprise:
(a) at least one L-shaped hook located on said at least one second annular bearing member and
(b) at least one opening located in said second mount element, said at least one opening being sized, shaped, and positioned to receive and releasably hold said at least one L-shaped hook.

11. A dot printer as recited in claim 7 wherein said first mount element is mounted on said printer head.

12. A dot printer as recited in claim 7 wherein said second mount element is mounted on said printer head.

13. A dot printer as recited in claim 7 wherein:
(a) a first pair of annular bearing members are slidably mounted on said first shaft;
(b) a second pair of annular pair of members are slidably mounted on said second shaft; and
(c) said first means comprise:
(i) two pins, each one of said two pins protruding from one of said first mount element and each one of said first pair of annular bearing members, and
(ii) two positioning holes, each one of said two positioning holes being located in the other one of said first mount element and each one of said first pair of annular bearing members and being sized, shaped, and positioned to receive a corresponding one of said two pins.

14. A dot printer comprising:
(a) a platen for holding a recording sheet;
(b) a first shaft disposed in parallel with said platen;
(c) a second shaft disposed in parallel with said platen and with said first shaft;
(d) a printer head;
(e) a first mount element located on said printer head and extending toward said first shaft;
(f) a second mount element located on said printer head and extending toward said second shaft;
(g) at least one first annular bearing member slidably mounted on said first shaft;
(h) at least one second annular bearing member slidably mounted on said second shaft;
(i) first means for releasably connecting said first mount element to said at least one first annular bearing member, said first means comprising:
(i) at least one pin protruding from one of said first mount element and said at least one first annular bearing member and
(ii) at least one positioning hole located in the other one of said first mount element and said at least one first annular bearing member and being sized, shaped, and positioned to receive said at least one pin; and
(j) second means for releasably connecting said second mount element to said at least one second annular bearing member, said second means comprising:
(i) at least one L-shaped hook located on said second annular bearing member and
(ii) at least one opening located in said second mount element, said at least one opening being sized, shaped, and positioned to receive and releasably hold said at least one L-shaped hook.

15. A dot printer as recited in claim 14 and further comprising a lock portion mounted on said at least one first annular bearing member for gripping a wire for moving said printer head relative to said platen.

16. A dot printer as recited in claim 14 wherein said first means comprise:
(a) at least one threaded fastener which comprises a head portion and a body portion;
(b) at least one threaded hole located in one of said first mount element and said at least one first annular bearing member and being sized and shaped to threadedly receive the body portion of said at least one threaded fastener; and
(c) at least one throughhole located in the other one of said first mount element and said first annular bearing member and being sized, shaped, and positioned to align with said at least one threaded hole, to pass the body portion of said at least one threaded fastener, and to engage the head portion of said at least one threaded fastener.

17. A dot printer as recited in claim 14 wherein said first mount element is mounted on said printer head.

18. A dot printer as recited in claim 14 wherein said second mount element is mounted on said printer head.

19. A dot printer as recited in claim 14 wherein:

(a) a first pair of annular bearing members are slidably mounted on said first shaft;

(b) a second pair of annular bearing members are slidably mounted on said second shaft; and (c) said second means comprises:

(i) two L-shaped hooks, one of said two L-shaped hooks being located on each one of said second pair of annular bearing members, and (ii) two openings located in said second mount element, each one of said two openings being sized, shaped, and positioned to receive and releasably hold a corresponding one of said two L-shaped hooks.

* * * * *